US005671486A

United States Patent [19]

Collavo

[11] Patent Number: 5,671,486

[45] Date of Patent: Sep. 30, 1997

[54] DECORATIVE COVER FOR A TOILET TANK

[76] Inventor: John E. Collavo, 1402 Missouri Ave., Bridgeville, Pa. 15017

[21] Appl. No.: 697,616

[22] Filed: Aug. 28, 1996

[51] Int. Cl.[6] ..... E03D 1/012

[52] U.S. Cl. ..... 4/353; 4/661; 4/901; 4/378

[58] Field of Search ..... 4/353, 225.1, 226.1, 4/227.1, 227.2, 366, 367, 378, 661, 901, 664, 665, 363

[56] References Cited

U.S. PATENT DOCUMENTS

| | | | |
|---|---|---|---|
| D. 311,771 | 10/1990 | Smith | D23/313 |
| D. 322,192 | 12/1991 | Alvey | D6/610 |
| 1,134,556 | 4/1915 | Recker | 4/227.1 |
| 3,015,827 | 1/1962 | Iwata | 4/664 |
| 4,202,056 | 5/1980 | Watkins | 4/661 |
| 4,646,780 | 3/1987 | Spooner | 4/353 |
| 4,932,084 | 6/1990 | Hanson | 4/353 |
| 5,073,998 | 12/1991 | Wood, Jr. et al. | 4/661 |

FOREIGN PATENT DOCUMENTS

| | | | |
|---|---|---|---|
| 255523 | 2/1963 | Australia | 4/664 |
| 2097436 | 11/1982 | United Kingdom | 4/664 |

*Primary Examiner*—Henry J. Recla
*Assistant Examiner*—Charles R. Eloshway
*Attorney, Agent, or Firm*—Kenneth P. McKay

[57] ABSTRACT

A toilet tank cover comprises two decorative figures. Discharge from the vent orifice of a cup type float valve flows up through the primary figure and out an exterior orifice to the secondary figure. The primary figure receives water discharge from the discharge vent of a cup type float valve. The discharge then flows through the primary figure to an emission point. At the emission point, the fluid is directed toward an opening in the second figure. The discharge flows through the secondary figure and drains directly into the waste standpipe of the toilet. The operation of the flush mechanism of the toilet is thereby monitored in an aesthetically pleasing fashion.

4 Claims, 2 Drawing Sheets

DECORATIVE COVER FOR A TOILET TANK

BACKGROUND OF THE INVENTION

1. Field of the Invention

The present invention relates generally to toilet tank covers, and more particularly to covers which may be decorative and pleasantly attractive while at the same time serving the function of monitoring the operation of the toilet.

2. Description of the Related Art

The current art shows very little associated to the current invention. All of the prior art relates to either purely aesthetic and functional improvement to the top of the toilet tank cover or relatively substantial changes to the entire tank exterior and interior mechanics in order to achieve a presumptively more efficient toilet. The current invention makes a rather minor adjustment to the mechanics of the toilet tank while simultaneously providing both a functional monitoring improvement and an aesthetic improvement.

The aesthetic possibilities for the top of a toilet tank cover are virtually endless. However, few of those possibilities simultaneously incorporated the functional aspect of the toilet operation thereby allowing for monitoring of the mechanical operation of the toilet tank fill mechanism. The instant invention couples both the aesthetic and the functional in a unique and simple manner providing the user both a decorative toilet lid and peace of mind.

PRIOR ART

U.S. Pat. No. 5,073,998 (WOOD, JR. ET AL.), discloses a toilet tank cover comprised of a frame to surround an existing toilet tank, brackets for mounting the frame onto the tank, and an actuator for flushing the toilet which replaces the existing flush handle.

U.S. Pat. No. 4,932,084 (HANSON), discloses a decorative toilet tank cover including a multiplicity of containment areas, at least one of which includes apertures on the bottom for drainage, a lid to cover at least one of the containment areas is provided with a slit for dispensing facial tissues and at least one side includes an integral decorative facade.

U.S. Pat. No. D322,192 (ALVEY), an ornamental design for a toilet tank cover comprised of a decorative fabric wrap of the entire tank.

U.S. Pat. No. D311,771 (SMITH), discloses another ornamental design for a toilet tank top comprised of a clock radio and other various conveniences.

SUMMARY OF THE INVENTION

The objective of the present invention is to provide a decorative toilet tank cover which allows for easier monitoring of the toilet tank fill mechanism operation as well as an aesthetic improvement to the top of the tank cover. Molded into the tank cover are two figures of any of a variety of shapes. The first figure receives the discharge from the float valve vent upon the flushing of the toilet. The discharge then flows through the figure to an emission point. At the emission point, the fluid is directed toward an opening in the second figure. The opening in the second figure allows the fluid to drain directly into the drain standpipe of the toilet. The instant invention thus allows the toilet tank fill mechanism of the toilet to be monitored without having to lift the standard toilet tank cover as fluid will only flow from the first figure to the second if the toilet tank fill mechanism is operating properly.

DETAILED DESCRIPTION OF THE PREFERRED EMBODIMENT

The invention will now be described in detail in relation to a preferred embodiment and implementation thereof which is exemplary in nature and descriptively specific as disclosed. As is customary, it will be understood that no limitation of the scope of the invention is thereby intended, and that the invention encompasses such alterations and further modifications in the illustrated device, and such further applications of the principles of the invention illustrated herein, as would normally occur to persons skilled in the art to which the invention relates.

Figure 1:
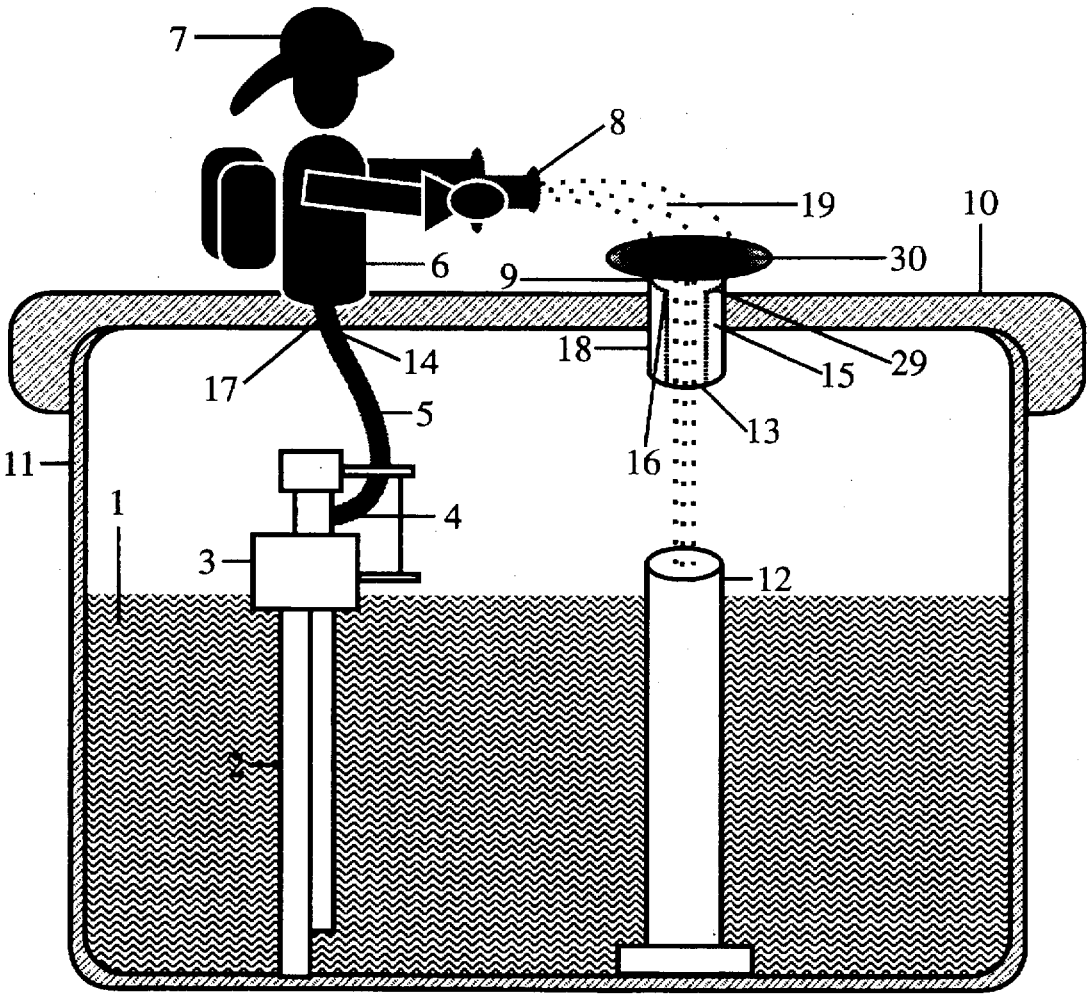
FIG. 1 is a diagrammatic illustration of a decorative toilet tank cover according to the present invention.

Thus, with reference now to FIG. 1 there is illustrated diagrammatically a decorative toilet tank cover. The cover is preferably made of plastic, cast plaster, or ceramic material. When a toilet is flushed, all the water 1 leaves the tank 11, and the tank 11 must then be filled. The tank 11 is filled by water 1 coming up through the fall standpipe 2. The water 1 then is directed into the tank 11 by the cup type float valve 3. The cup type float valve 3 has a water discharge vent 4 which emits water discharge from cup type float valve 3. A discharge tube 5 is attached to the vent opening 4. The discharge tube 5 is attached at its other end to a nipple connector 14 installed on the receiving end of the primary conducting channel 6 that runs through the primary FIG. 7 that is mounted onto a flat rectangular lid plate 10. The primary conducting channel 6 runs through the primary orifice 17 of the flat rectangular lid plate 10.

The primary conducting channel 6 guides the water discharge 19 through the primary FIG. 7 to the primary discharge end 8. The water discharge 19 leaves the primary discharge end 8 and is directed into a secondary FIG. 9. The secondary FIG. 9 has a bowl-shaped cavity 29 within which has baffles 30 to suppress the splashing of water discharge 19 which is directed into the bowl-shaped cavity 29 from the primary FIG. 7. The water discharge 19 in the bowl-shaped cavity 29 drains through the secondary receiving end 16 of the secondary conducting channel 15. The secondary conducting channel 15 runs through the secondary orifice 18 of the flat rectangular lid plate 10. The water discharge 19 travels through the secondary conducting channel 15 into the secondary discharge end 13 and drains down into the waste standpipe 12.

Figure 2:
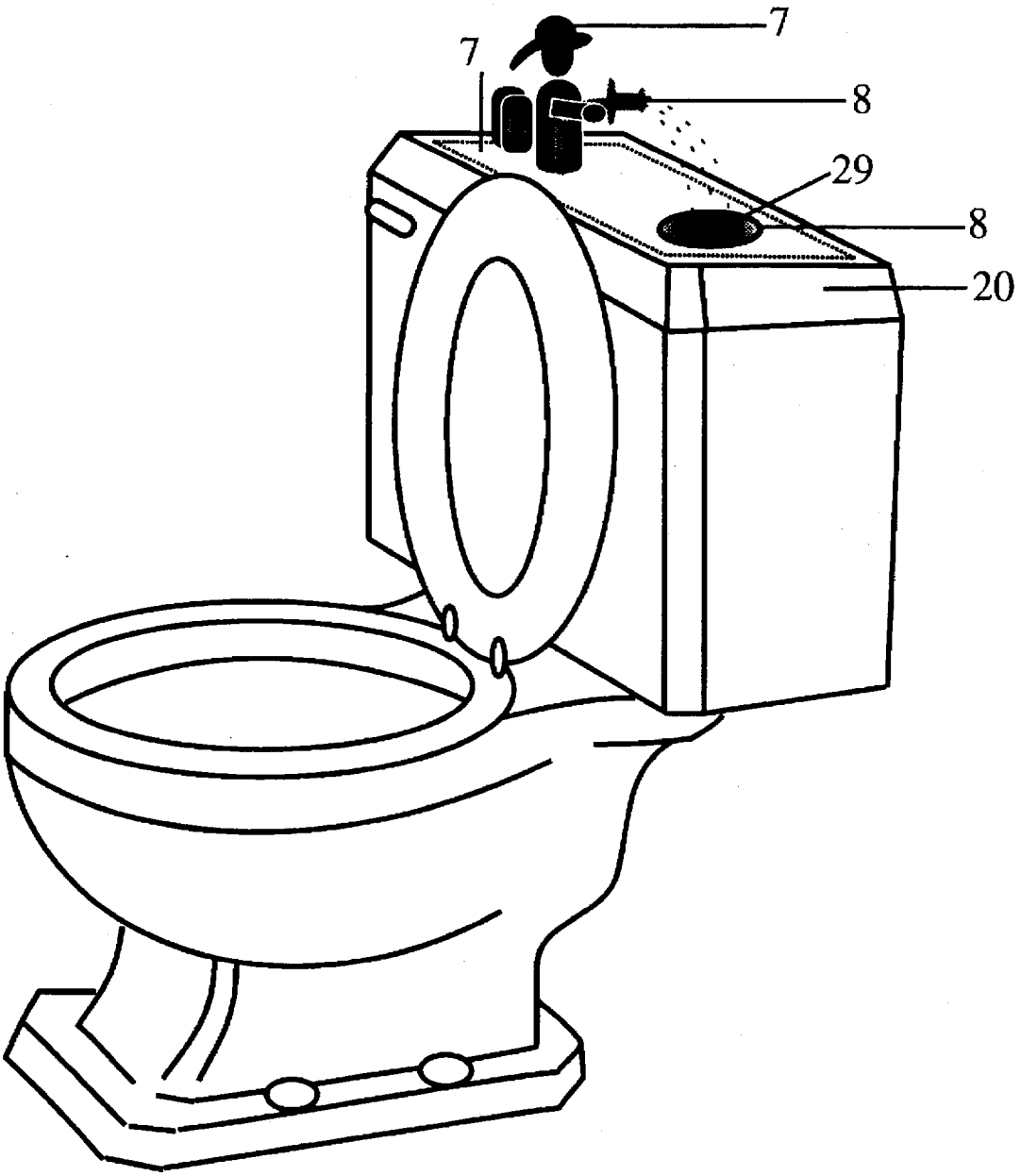
FIG. 2 is another diagrammatic illustration of a downward view of present invention.

With reference now to FIG. 2, there is illustrated diagrammatically a downward perspective of the instant invention. The standard toilet tank 11 has a top opening 21. A circumferential lip 20 surrounds the standard toilet tank 11. Water discharge flows 19 via gravity from the primary discharge end 8 of the primary FIG. 7 to the bowl shaped cavity 29 within the secondary FIG. 9.

What is claimed is:

1. A decorative cover for a standard toilet tank with a top opening, a fill standpipe, a cup type float valve flushing mechanism connected to said fill standpipe and having a water discharge vent for delivering refill water from said standpipe to said bowl after flushing and a water outlet for refilling said tank with water from said standpipe after flushing, and a waste standpipe therein, comprising:

a) a flat rectangular lid plate having a circumferential lip whereby said circumferential lip is adapted to surround said standard toilet tank around said top opening and having a primary orifice and a secondary orifice, said primary orifice being opposite said cup type float valve flushing mechanism and said secondary orifice being opposite said standpipe when said flat rectangular lid plate is mounted on said standard toilet tank;

b) a primary figure mounted on said flat rectangular lid plate and having a primary conducting channel therein, said primary conducting channel having a primary discharge end and a primary receiving end, said primary receiving end having a nipple connector installed therein, and having a discharge tube connecting said nipple connector with said water discharge vent of said cup-type float valve flushing mechanism; and, c) a secondary figure mounted on said flat rectangular lid plate opposite said primary discharge end, and having a bowl-shaped cavity with a perimeter, said cavity having baffles disposed therein along said perimeter, and having a secondary conducting channel from said perimeter, said secondary conducting channel having a secondary discharge end and a secondary receiving end for receiving water from said cavity, said secondary figure positioned on said flat rectangular lid plate whereby actuation of said cup type float valve flushing mechanism discharges water from said standpipe to said water discharge vent through said discharge tube and primary conducting channel into said bowl-shaped cavity against said baffles and into said conducting channel and thence into said waste standpipe.

2. A decorative cover for a standard toilet tank as claimed in claim 1, further comprising a decorative cover made of plastic material.

3. A decorative cover for a standard toilet tank as claimed in, claim 1, further comprising a decorative cover made of cast plaster material.

4. A decorative cover for a standard toilet tank as claimed in claim 1, further comprising a decorative cover made of ceramic material.

* * * * *